United States Patent [19]

Kobayashi et al.

[11] Patent Number: 4,599,259

[45] Date of Patent: Jul. 8, 1986

[54] COVER FILM FOR SUBLIMATION TRANSFER TYPE HARD COPY

[75] Inventors: Naotake Kobayashi; Tetsuya Abe; Satoru Shinohara; Yoshio Fujiwara, all of Utsunomiya, Japan

[73] Assignee: Sony Corporation, Tokyo, Japan

[21] Appl. No.: 624,683

[22] PCT Filed: Oct. 25, 1983

[86] PCT No.: PCT/JP83/00374

§ 371 Date: Jun. 22, 1984

§ 102(e) Date: Jun. 22, 1984

[87] PCT Pub. No.: WO84/01745

PCT Pub. Date: May 10, 1984

[30] Foreign Application Priority Data

Oct. 25, 1982 [JP] Japan ..... 57-187066
Nov. 8, 1982 [JP] Japan ..... 57-195588

[51] Int. Cl.[4] ..... B41M 5/26

[52] U.S. Cl. ..... 428/204; 8/470; 8/471; 428/201; 428/203; 428/207; 428/211; 428/336; 428/413; 428/475.5; 428/479.6; 428/480; 428/481; 428/514; 428/522; 428/536; 428/690; 428/704; 428/913; 428/914

[58] Field of Search ..... 8/470, 471; 428/195, 428/203, 204, 207, 212, 220, 328, 913, 914, 918, 201, 211, 336, 413, 475.5, 479.6, 480, 481, 514, 522, 536, 690, 704

[56] References Cited

U.S. PATENT DOCUMENTS 3,900,653 8/1975 Riboulet et al. ..... 428/918

FOREIGN PATENT DOCUMENTS 0020159 4/1982 Japan ..... 428/914

*Primary Examiner*—Bruce H. Hess
*Attorney, Agent, or Firm*—Hill, Van Santen, Steadman & Simpson

[57] ABSTRACT

A cover film for a sublimation transfer type hard copy of the present invention is a cover film which is melt bonded by heat on the surface of a hard copy printing paper in which a picture image is formed on the surface thereof by selectively transferring a sublimation dye. The cover film includes a resinous layer containing a metal compound selected from Al, Mg, Ca and Sn. This cover film is capable of producing magenta color of high color saturation by arbitrarily controlling the coloring of reddish dye to be shifted to the blue side and can also protect the surface of the printing paper.

Furthermore, the present invention relates to a cover film which is melt bonded by heat on the surface of a hard copy printing paper in which a picture image is formed on the surface thereof by selectively transferring a sublimation dye. This cover film includes a layer mainly formed of a phosphor whitener and a resin to increase a whiteness degree of a portion which is not colored so that a picture image is made clear and which can prevent the color of dye from being faded.

8 Claims, 4 Drawing Figures

COVER FILM FOR SUBLIMATION TRANSFER TYPE HARD COPY

TECHNICAL FIELD

The present invention relates to a cover film for a sublimation transfer type hard copy which can be adhered by melt to the surface of a hard copy printing paper on the surface of which a picture image is formed by selectively transferring a sublimation dye to the surface of the printing paper.

BACKGROUND ART

So far it has been proposed that a dye carrier paper having an ink containing sublimation dye is superposed at its one surface to a printing paper having surface treatment, the dye carrier paper is heated at another side by a thermal print head and the dye in the ink is sublimated and thermally transferred to the printing paper whereby to obtain a color hard copy. On the surface of the hard copy thus made is adhered by melt a cover film as a surface protective layer so that when a hand, for example touches the surface of the hard copy, color of the hard copy can be prevented from being faded by oils and the like carried from the hand to the surface of the hard copy.

FIG. 1 shows an overall structure of an example of a prior art cover film for a sublimation transfer type color hard copy.

In FIG. 1, reference numeral 1 designates a cover material and this cover material 1 is supported by a base material 2 to form the whole of a cover film 3 for a sublimation transfer type color hard copy. The cover material 1 is made of polyester resin (VYLON #200, manufactured by Toyobo Co., Ltd.) of 5 μm thickness having melt bonding property. The base material 2 is made of polyester film of 12 μm thickness, and the cover material 1 is coated on the surface of the base material 2.

FIG. 2 shows another example of the prior art cover film for a sublimation transfer type color hard copy.

In FIG. 2, like parts corresponding to those in FIG. 1 are marked with the same references and will not be described in detail.

In this example, on a base material 2 made of polyester film having a thickness of 12 μm is formed a first layer of 1*a* cover material of about 5 μm thickness made of cellulose acetate butylate resin (manufactured by Sumitomo Bayer Urethane Co., Ltd.) on which a second layer 1*b* of cover material of about 5 μm thickness made of polyester resin having melt bonding property is further formed. By the way, although in the color hard copy formed by the transfer of dye the dye is partly diffused and colored in the surface treated layer on the surface of the printing paper, most of the transferred dye is still coagulated so that the dye can not present its original color sufficiently. A dye having a relatively satisfactory coloring property suitable for sublimation transfer printing is frequently found out in dispersing dyes, basic dyes and solvent dyes. However, when such dye is used in the dye carrier paper, most of such dye is limited to the dispersing dye and the kinds of such dye are limited to several tens in practice. When the colors of the dye are classified into three primary colors, cyan, magenta and yellow in accordance with subtractive color mixture, the kinds of dye suitable for the color hard copy are further limited for each primary color. When the hues of these dyes transferred on the printing paper are observed, particularly the magenta color becomes reddish. As a result, of red, green and blue colors as the mixed colors of three primary colors of the subtractive color mixture, particularly red color presents a yellowish color, namely, a color close to orange color. For this reason, it was desired that the coloring of reddish dye was arbitrarily controlled to shift bluish side so as to present an optimum magenta color suitable for mixed colors.

In this connection, the present inventor got the following experimental results regarding the coloring of reddish dye in the case where the prior art cover films of sublimation transfer type shown in FIGS. 1 and 2 were used.

In the first experiment, a printing paper for a sublimation transfer type color hard copy was formed such that a coating composition formed of 24 parts by weight of internally plasticized saturated polyester resin (VYLON #200, manufactured by Toyobo Co., Ltd.), 6 parts by weight of ultra fine particle silica (NIPSIL E220A, manufactured by Nippon Silica Industrial Co., Ltd.) and 70 parts by weight of methyl ethyl ketone solvent was coated on one surface of a best quality paper having an area weight of 170 g/m$^2$ so as to have a coating weight of about 5 g/m$^2$ after being dried. On the other hand, a dye carrier paper to obtain a print sample was formed such that an ink for magenta color formed of 6 parts by weight of anthraquinone-series reddish dispersing dye (PTR 63, manufactured by Mitsubishi Chemical Industries Co., Ltd.), 6 parts by weight of ethyl cellulose and 88 parts by weight of isopropyl alcohol solvent was coated on a thin paper having an area weight of 40 g/m$^2$ by using a gravure coater so as to have a coating weight of 5 g/m$^2$ after being dried. Then, a picture image of magenta color was printed on the printing paper by heating from the back of the dye carrier paper with a thermal print head heated at a temperature of about 300° C. under the condition that the printing paper was in contact with the ink coated surface of the dye carrier paper, and a sample of a sublimation transfer type color hard copy was obtained. Then, the cover film B in the above example shown in FIG. 1 was pressedly attached on the hard copy by using a hot plate heated at 150° C. thus a color print being obtained. In this experiment, since the change of red color was expressed as 0.456 by a chromaticity coordinate X value of CIE (Commission International de L'Eclairage) standard colorimetric system, the coloring of reddish dye had to be controlled to properly shift bluish side so as to present the magenta color of high color saturation. The X value of the CIE standard colorimetric system means that the larger X value increases the degree of red color, while the smaller X value increases the degree of blue color.

In the second experiment, after the cover film 3 in the example shown in FIG. 2 was formed on the sample hard copy formed in the first experimental example by a hot press, the base material 2 made of polyester film was released therefrom so that a sublimation transfer type cover film layer was formed on the printing paper thus a color print being obtained. Since the change of red color in the second experiment was expressed as 0.462 by a chromaticity coordinate X value of CIE standard colorimetric system, the coloring of reddish dye had to be controlled to properly become bluish so as to present the magenta color of high color saturation.

The printing paper suitable for the sublimation transfer color copy is generally formed such that a small amount of resin such as polyester resin, epoxy resin, nylon resin, polyvinyl pyrrolidone resin, acetate cellulose or the like which can easily adsorb and diffuse a dye is coated on the surface of the printing paper.

However, these resins are all colored slightly yellowish and as the resin ages, such resin is apt to be colored yellowish easily. In addition, a paper on which such coating composition is coated is generally colored yellowish and the degree of yellowish color is raised more by heat generated from the coating composition when it is dried or hardened. As a result, the picture image printed on the printing paper is caused to lose its clearness, and in the case of the colored layer formed by a dye of high transparency, its hue itself is caused to be displaced from its original hue. On the other hand, it was necessary that a paint of high whiteness such as titanium oxide or the like was added into the coating composition to increase whiteness degree. If necessary, a phosphor whitener or a small amount of blue color dye must be added thereinto so that a paper used to form thereon a picture image inevitably became expensive.

Alternatively, after the dye carrier paper formed by using the sublimation dye and the printing paper subjected to the surface treatment were superposed on each other with a predetermined positional relation, the sublimation dye sublimated by heating mainly from the back of the dye carrier paper was transferred on the coating layer on the surface of the printing paper thus the picture image being formed. Although the dye transferred on the printing paper was partly diffused into the coating composition layer and colored, most of the dye was coagulated and merely transferred thereon. Therefore, the dye could not present its original color satisfactorily. In addition, the dye is easily faded by oils and the like carried from, for example, hands and is also easily faded by ultraviolet rays contained in natural light and oxygen in the air.

The third and fourth experiments regarding the prior art technique in which the conventional cover film for a color hard copy printing paper was melted by heat on the printing paper will be described in detail.

The third experiment using the prior art technique will be described as follows. An aqueous solution for surface treatment of the printing paper formed of polyvinyl pyrrolidone (manufactured by General Aniline & Film Corporation), polyester resin (VYLONAL MD-1200, manufactured by Toyobo Co., Ltd.) and calcium carbonate (manufactured by Nitto Funka Kogyo Kabushiki Kaisha) was coated on a best quality paper of area weight of 170 g/m$^2$ which was not particularly bleached for the purpose of forming a picture image to have a coating amount of about 5 g/m$^2$ and thus a printing paper of whiteness degree of 91.2 was obtained. Then, as shown in FIG. 1, the cover material 1 of 5 $\mu$m thickness made of linear polyester resin (VYLON #200, manufactured by Toyobo Co., Ltd.) was formed on the base material 2 of 15 $\mu$m thickness made of polyester film to form the cover film 3 for a sublimation transfer type hard copy. This cover film 3 and the above printing paper were made in contact with each other and pressed to each other by hot press at about 150° C. and the cover film 3 in this example was melted by heat on the printing paper thus a color print sample being obtained. In this experiment, if the whiteness degree of pure white was taken as 100, the whiteness degree of the color print sample was 91.2. Moreover, according to the CIE standard colorimetric system chromaticity coordinate (the achromaticity axes by Macbeth Corporation were presented as $x=0.310$ and $y=0.316$), $x=0.317$ and $y=0.327$ were obtained. Thus, similarly to the case in which the cover film was not melted by heat on the printing paper, the whiteness degree and the clearness were not satisfactory.

The fourth experiment using the prior art technique will be described as follows. An ink for cyan color was formed of 6 parts by weight of sublimation cyan dye (KAYALON FAST BLUE-BR, manufactured by Nippon Kayaku Co., Ltd.), 6 parts by weight of ethyl cellulose and 88 parts by weight of isopropyl alcohol solvent. This ink for cyan color was coated on the surface of a paper having an area weight of 40 g/m$^2$ by using a gravure coater so as to have a coating amount of 5 g/m$^2$ after being dried and thus a dye carrier paper was formed. Then, this dye carrier paper and a printing paper prepared similarly to the third experiment using the prior art technique were superposed on each other, pressed for 5 seconds from the side of the dye carrier paper by hot press heated at 200° C., and the sublimation dye was sublimated from the dye carrier paper, thus a picture image being transferred on the printing paper. Then, the cover film 3 prepared by the above third experiment using the prior art technique was superposed on the color print and heated to form a colored color print.

In this experiment, this color print was exposed to ultraviolet rays for 100 hours by using a fade meter (standard ultraviolet ray long life fade meter, manufactured by Suga Test Instruments Co., Ltd.) and thereafter its tenebrescence was measured by Macbeth reflection density meter RD-514 on the basis of the change of cyan concentration. The cyan concentration of the color print before being exposed to the ultraviolet rays was 1.24 and the cyan concentration thereof after being exposed to the ultraviolet ray was 1.11, resulting in color fading ratio of 1.24. As a result, something had to be done to prevent the color from being faded.

In view of the above aspects, the present invention is to provide cover film for a sublimation transfer type hard copy capable of producing magenta color of high color saturation by arbitrarily controlling the coloring of reddish dye to be shifted to the blue side and which can protect the surface of the printing paper.

Also, the present invention is to provide a cover film for a sublimation transfer type hard copy in which a dye on a printing paper is diffused and colored to increase a whiteness degree of a portion which is not colored so that a picture image is made clear and which can prevent the color of dye from being faded.

DISCLOSURE OF INVENTION

A cover film for a sublimation transfer type hard copy of the present invention is a cover film which is melted by heat on the surface of a hard copy printing paper in which a picture image is formed on the surface thereof by selectively transferring a sublimation dye. The cover film includes a layer mainly formed of a metal compound selected from Al, Mg, Ca and Sn and resin. This cover film for a sublimation transfer type hard copy is capable of producing magenta color of high color saturation by arbitrarily controlling the coloring of reddish dye to be shifted to the blue side and can protect the surface of the printing paper.

Also, the present invention relates to a cover film which is melted by heat on the surface of a hard copy printing paper in which a picture image is formed on the surface thereof by selectively transferring a sublimation dye. This cover film includes a layer mainly formed of phosphor whitener and resin to increase a whiteness degree of a portion which is not colored so that a picture image is made clear and which can prevent the color of dye from being faded.

BEST MODE FOR CARRYING OUT THE INVENTION

Figure 1:
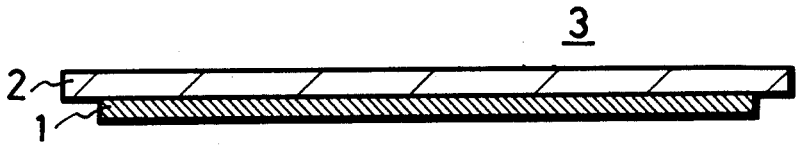
FIG. 1 (PRIOR ART)
FIGS. 1 to 4 are diagrams useful for explaining a cover film for a sublimation transfer type hard copy of the present invention.

Embodiments of the cover film for a sublimation transfer type color hard copy according to the present invention will hereinafter be described in detail.

The cover film of the present invention includes a bonding agent layer of hot melting property formed by dispersing or dissolving a metal compound of Al, Mg, Ca and Sn of metals into a coating composition such as polyester resin, epoxy resin, acetate cellulose resin, nylon resin, polyvinyl pyrrolidone resin and the like into which a sublimation dye is easily transferred and diffused. This cover film, when being melted by heat on a printing paper formed by coating a coating composition on one surface of a base material of heat resisting property, can diffuse and color the dye and can control magenta color.

Of metal compounds of Al, Mg, Ca and Sn, such one capable of forming a transparent bonding layer by dispersing or dissolving itself into the coating composition is used as a metal compound used in the present invention. For example, there are enumerated metal salts of organic acid which are compounds formed by reacting organic acid such as oleic acid, naphthenic acid, stearic acid, 2-ethyl hexonoic acid and the like with the above metals, metal alcoholates such as aluminum butylate, aluminum isopropylate which are reaction products of aluminum with alcohol such as ethyl alcohol, isopropylalcohol, butylalcohol, 2-ethyl hexyl alcohol and so on, chelate compound between acetyl acetonate and metal, such as aluminum acetonate, and aluminum oxide acylate compound, such as aluminum oxide stearate. The reason why the coloring of the sublimation reddish dye of the invention can be controlled to be shifted to the bluish hue is not clear. However, one of the reasons may be considered such that since the most of red dye having a high sublimation transferring property belongs to anthraquinone-series dispersing dye, amino group and hydroxyl group which are polar groups in anthraquinone-series dye and metal atom activated in the present invention react with dye diffused in the bonding agent when the cover film is melt by heat on the printing paper to thereby instantaneously form, for example, chelate compound and the like so that a bluish coloring material of molecular shape is increased uniformly. While the amount of such metal compound is practically selected in a range from 0.1 to 30 PHR (parts per hundred parts of resin), the above value is selected on the basis of the kinds of dye and the coloring degree and it is not limited particularly.

The results of experiments (experiment examples -1 to -4) carried out by the inventor of the present invention will be described.

EXPERIMENTAL EXAMPLE-1

In this example -1, the cover material 1 made of polyester resin having a hot melt property and containing 8 PHR of ethyl acetacetate aluminum diisopropylate (ALCH, manufactured by Kawaken Fine Chemical Co., Ltd.) is formed on a base film 2. Thus the cover film is formed in the form shown in FIG. 1. Other portions were formed similar to those of the sublimation transfer type color hard copy film of the prior art example shown in FIG. 1. The cover film is hot pressed on the color print obtained in the previously explained first experiment. As compared with that of the prior art, the X value based on the CIE standard colorimetric system in this experimental example was made as small as 0.360 so that the bluish component was increased and the reddish coloring of magenta color was suppressed.

EXPERIMENTAL EXAMPLE-2

Figure 2:
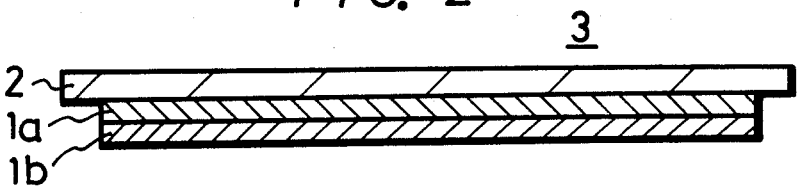
FIG. 2 (PRIOR ART)

In the experimental example- 2, the cover material second layer **1*b* of the cover film for a sublimation transfer type color copy prepared in the prior art example shown in FIG. 2 was formed in such a manner that aluminium oxide stearate (OLIVE AOS, manufactured by Hope Pharmacentical Co., Ltd.) of 10 PHR relative to resin was dissolved in advance into polyester resin. Other portions were formed similar to those of the prior art example shown in FIG. 2. This cover film for a sublimation transfer type color hard copy was similarly hot pressed on the sample color print and the dye was diffused and colored. Thereafter only the base material 2** made of polyester film was released therefrom to form a cover film layer of the sublimation transfer type. As compared with that of the prior art, the X value based on the CIE standard colorimetric system in this experimental example was made as small as 0.358 so that the bluish component was increased to suppress the reddish coloring of magenta color.

EXPERIMENTAL EXAMPLE-3

In the experimental example-3, the cover material 1 in the above example shown in FIG. 1 was formed such that a resin liquid formed by dissolving 10 PHR of 2-ethy hexylic calcium (OCTOPE "Ca", manufactured by Hope Pharmacentical Co., Ltd.) into solvent of polyvinyl pyrrolidone (manufactured by General Aniline & Film Corporation) was dried to form a layer of about 7 μm after being dried. Other portions were formed similar to those of the example shown in FIG. 1. This cover film for a sublimation transfer type color hard copy was similarly hot pressed on the sample color hard copy and diffused and then colored. Thereafter, only the base material 2 was released therefrom to form a transfer cover film layer. As compared with that of the prior art, the X value based on the CIE standard colorimetric system in this experimental example was made as small as 0.372 so that the bluish component was increased to suppress the reddish coloring of magenta color.

EXPERIMENTAL EXAMPLE - 4

Figure 3:
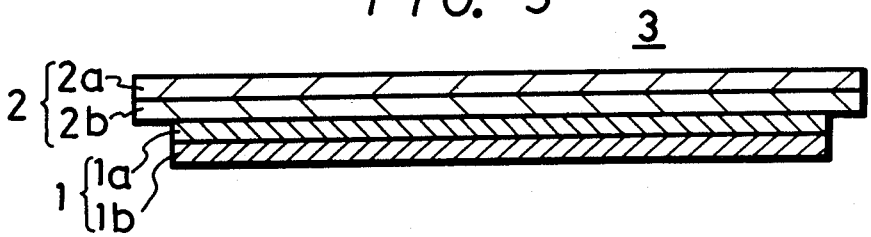

The experimental example - 4 will be described with reference to FIG. 3. In FIG. 3, like parts corresponding to those in FIGS. 1 and 2 are marked with the same references and will not be described in detail.

In FIG. 3, reference numeral **2*a* designates a condenser paper of 15 μm thickness, and a heat resisting film layer 2*b* was formed on one surface of the condenser paper. The heat resisting film layer 2*b* was formed in such a manner that a coating composition made of 21 parts by weight of polyurethane acrylate (XP7000B, manufactured by Nippon Synthetic Chemical Industry Co., Ltd.), 9 parts by weight of epoxy acrylate (SP1509, manufactured by Showa High-polymer Co., Ltd.) and 70 parts by weight of methyl ethyl ketone was coated on the one surface of the condenser paper to have a thickness of about 5 μm and cured by irradiating the electron beam of about 10 Mrad in nitrogen atmosphere. The cover material first layer 1***a* was formed on the other surface of the heat resisting film layer by using cellulose acetate propionate resin (manufactured by Sumitomo Bayer Urethane Co., Ltd.) of about 5 μm thickness. The cover material second layer 1*b* was formed of resin of about 5 μm thickness which was made by dissolving into polyester resin, ethyl acetacetate aluminium diisopropylate (ALCH, manufactured by Kawaken Fine Chemical Co., Ltd.). On the other hand, similarly to the above experimental examples, this cover film was hot pressed on the sample color hard copy. Thereafter, only the condenser paper together with the heat resisting film layer 2*b* was released therefrom and the cover film layer was formed on the printing paper. As compared with that of the prior art, the X value based on the CIE standard colorimetric system in this experimental example was made as small as 0.359 so that the bluish component was increased to suppress the reddish coloring of magenta color.

TABLE - 1

| | experiment number | X value on CIE standard colorimetric system |
|---|---|---|
| Prior art | first experimental example | 0.456 |
| | second experimental example | 0.462 |
| The present invention | experimental example - 1 | 0.360 |
| | experimental example - 2 | 0.358 |
| | experimental example - 3 | 0.372 |
| | experimental example - 4 | 0.359 |

As described above, as will be clear from the results indicated on the table - 1, when the cover film for a sublimation transfer type color hard copy of the present invention is used, the X value becomes smaller than that of the prior art, or the bluish component is increased to suppress the reddish coloring of magenta. Moreover, since the blue coloring can freely be controlled by selecting the kinds and adding amount of the metal compounds described in the present invention, an optimum magenta color can be obtained. Furthermore, since the cover film forms the protective layer for dye, the surface of the sublimation transfer type hard copy can be protected.

Figure 4:
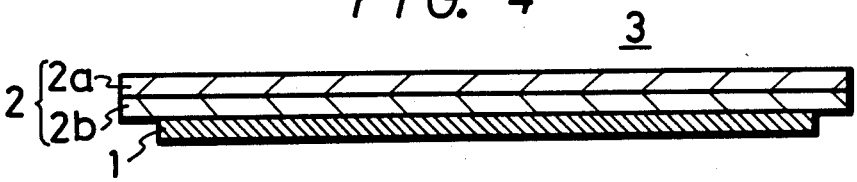

The following versions can further be considered for the structure of the cover film for a sublimation transfer type hard copy according to the present invention. The base material 2 can be formed as a plastic base material having relatively excellent heat resisting property and smooth surface or if necessary, undergoes pear-skin treatment and releasing treatment, such as polyester, polycarbonate, polyacrylate and the like. Alternatively, the base material can be made to have a double-layer structure as shown in FIG. 4 in which the above film is superposed on the surface of the paper formed as the first layer 2*a* of the base material. Also, the base material can be made to have a high smoothing property by coating thereon a curable heat resisting coating composition (for example, silicone resin, unsaturated polyester resin and so on) 2*b*. The thickness of the base material 2 is selected to be in a range from 20 to 100 μm, preferably 20 to 50 μm. This thickness can freely be selected in consideration of easy handling and of time necessary for hot press, etc. The cover material 1 is made of mainly an achromatic and transparent thermoplastic resin which can cut ultraviolet rays containing the metal compound which layer is not adhered by melt on the base material but melt bonded on the printing paper and metal compound. The cover material 1 formed of the two layers 1*a* and 1*b* can be formed such that one layer at the base material side is formed as an achromatic and transparent curable heat resisting resin layer (for example, curable urethane resin, curable polyester resin and the like) which is not melt bonded by heat on the base material or a resin layer such as acetate resin which can inherently cut out the ultraviolet rays. The other layer can be formed from the layer 1*b* which is mainly made of achromatic and transparent resin having a melt bonding property relative to the printing paper and the upper layer 1*a* and containing the metal compound. The thickness of the cover material is selected in a range from 1 to 20 μm, preferably 5 to 10 μm. To avoid ultraviolet rays, it is desired that ultraviolet ray absorbent of a predetermined amount is added into the cover material. Since most of sublimation dye belongs to the dispersing dye, a resin such as polyester, epoxy, nylon and the like to which the dispersing dye is transferred quite easily is coated on the surface of the printing paper so as to increase the transfer property of dye. To this end, while the material for the cover material 1 or 1*b* must be selected to be a resin which can be melt bonded by heat on these resins, any resins can be used so long as the composition of resin enables the resin to be melt bonded by heat. It is possible that the surface of the base material undergoes silicone-series or fluorine-series releasing treatment so as to easily be released from the cover material. Ultraviolet rays may be shielded by using a resin material through which ultraviolet rays are difficult to pass inherently or by mixing an ultraviolet ray absorbent into the cover material. In addition to benzophenon-series ultraviolet ray absorbent such as hydroxy benzophenon, dihydroxy benzophenon and the like, benzo triazol-series or salicylic acid derivative and the like can be used as the above ultraviolet ray absorbent. In addition, the base material 2 can be left on or removed from the cover material 1 or 1*b*, if necessary.

Also in the present invention, the cover film includes a layer which is formed of mainly a phosphor whitener and a resin.

The phosphor whiteners can be used are 4-4'-bis 4, 6 di-substituted-1, 3, 5-triadinyl disulfonic acid (wherein the substituted groups are amine, alcohol, phenol or so), α,β-bis (benzoxyzoryl) ethylene compound, alkoxy naphthalene acid-N-substituted imide compound, anthracene derivatives such as, 9, 10, -dichloro anthracene and so on, stilben derivatives such as diaminostilben and so on, quinolone derivatives, coumarin derivatives such as 7-diethylamino-4-methyl coumarin and so on, imidazol derivatives such as benzoimidazole or the like and oxazol derivatives such as benzoxazole or the like. The phosphor whitener is effective if it is added to the resin with an adding amount of 0.01 to 5 PHR. Also, it is possible that the ultraviolet ray absorbent is mixed into the cover film layer. In addition to benzophenon-series ultraviolet ray absorbent such as hydroxy benzophenon, dihydroxy benzophenon and the like, benzo triazol-series or salicylic acid derivative and the like can be used as the above ultraviolet ray absorbent.

When the cover film of the present invention is used, the phosphor whitener generally absorbs ultraviolet rays and changes the same to light rays of short wavelength in the visible range so that in addition to the inherent function of the cover film in which the surface of the color print can be protected from oils and the coagulated dye can be diffused and colored by heating, the tenebrescence of dye can be suppressed by shielding ultraviolet rays. Furthermore, even in a little yellowish printing paper of insufficient whiteness degree which is produced at low cost, the whiteness degree of other portions than the picture image can be increased and thus a clear picture image can be obtained.

Various experiments regarding the present invention, which can prove the effects of the present invention, will be described with reference to the following table. To compare the effects of the present invention with those of the prior art techniques, the results of the third and fourth experiments using the prior art techniques relating to the prior art cover film for a sublimation transfer type hard copy are also indicated on the following table.

TABLE

| Name of experiment | Whiteness degree | CIE x | CIE y | Exposed to ultraviolet rays: concentration before being exposed to ultraviolet rays | Exposed to ultraviolet rays: concentration after being exposed to ultraviolet rays | Exposed to ultraviolet rays: tenebrescence ratio (%) |
|---|---|---|---|---|---|---|
| Third experiment of prior art technique | 91.2 | 0.317 | 0.327 | — | — | — |
| Third experiment of prior art technique | — | — | — | 1.24 | 1.11 | 10.48 |
| Experiment 5 of the present invention | 92.4 | 0.307 | 0.311 | 1.24 | 1.18 | 4.84 |
| Experiment 6 of the present invention | 92.1 | 0.306 | 0.310 | 1.24 | 1.16 | 6.45 |
| Experiment 7 of the present invention | 92.9 | 0.306 | 0.311 | 1.24 | 1.20 | 3.23 |
| Experiment 8 of the present invention | — | — | — | 1.24 | 1.23 | 0.81 |

In the experiment 5 of the present invention, the cover film 3 was formed by dissolving a phosphor whitener of 2 PHR (UVITEX - OB, manufactured by Ciba Geigy A.G.) into the cover material 1 made of linear polyester resin of 2 μm thickness in accordance with the third experiment using the prior art technique. Similarly to the third experiment using the prior art technique, a printing paper of whiteness degree of 91.2 was formed such that a printing paper coating composition aqueous solution made of polyvinyl pyrrolidone (manufactured by General Aniline & Film Corporation), polyester resin (VYLONAL MD-1200, manufactured by Toyobo Co., Ltd.) and calcium carbonate (manufactured by Nitto Funka Kogyo Kabushiki Kaisha) was coated on a best quality paper of area weight of 170 g/m$^2$, which was not particularly bleached for forming a picture image, so as to have a coating amount of about 5 g/m$^2$. Then, the cover film of the present invention into which the phosphor whitener was dissolved was formed on the printing paper by using a hot press at about 150° C. As a result, the cover film was melt bonded on the printing paper and thus a color print was formed. The whiteness degree of the color print in the experiment 5 of the present invention was measured by a color measuring color difference meter, NP101DC type (manufactured by Nippon Denshoku Kogyo Kabushiki Kaisha) and the result was 92.4. In the chromaticity coordinate of the CIE standard colorimetric system, x=0.307 and y=0.311 were established and thus it was confirmed that the whiteness degree was improved as compared with the prior art. This cover film was tightly pressed on the color copy to thereby form a sample color print. This sample color print was exposed to ultraviolet rays for 100 hours by using the fade meter (standard ultraviolet long life fade meter). Then, the fluctuation of cyan concentration before and after being exposed to the ultraviolet rays was measured by the Macbeth reflection density meter RD-514. The measured results were presented such that the cyan concentration of the sample color print before being exposed to the ultraviolet rays was 1.24 and that after being exposed to the ultraviolet rays was 1.18, the color fading ratio being presented as 4.84%. The color fading ratio was significantly decreased to 4.84 as compared with that of the prior art, and it was confirmed that the color of the sample color print is difficult to be faded.

In the experiment 6 of the present invention, the cover material 1 of 5 μm thickness made of polyvinyl pyrrolidone into which a phosphor whitener, whitex WS (manufactured by Sumitomo Chemical Co., Ltd.) of about 1 PHR was dissolved was formed on the base material 2 made of polyester film of 12 μm thickness. Then, similarly to the experiment 5 of the present invention, the cover material was hot pressed on the printing paper and thereafter the polyester film 2 was released therefrom to form the transfer cover film layer. The whiteness degree of the color print in the experiment 6 of the present invention was measured by the color difference meter. The result was 92.1, and in the chromaticity coordinate of the CIE standard colorimetric system, x=0.306 and y=0.310 were presented. As a result, it was confirmed that the whiteness degree was improved as compared with that of the prior art. Similarly to the experiment 6 of the present invention, the cover film of this experiment was tightly pressed on the color copy to thereby form a color print and the color fading ratio thereof was measured. The cyan concentration of the sample color print before being exposed to the ultraviolet ray was 1.24 and that of the sample color print after being exposed to the ultraviolet ray was 1.16, the color fading ratio being presented as 6.45%. Thus, it was ascertained that the color print of the experiment 6 of this invention is difficult to be color faded.

In the experiment 7 of the present invention, the first layer **1*b* having the thickness 5 μm as shown in FIG. 2 made of cellulose acetate butylate of 5 μm thickness (manufactured by Sumitomo Bayer Urethane Co., Ltd.) into which a phosphor whitener, Whitefluor G(Sumitomo Chemical Co., Ltd.) of 1 PHR was dissolved was formed on the base material 2 made of polyester film having the thickness, 12 μm on which the second layer 1***a* of 5 μm thickness made of polyester resin layer was further formed, thus a cover film layer being formed. Under the similar conditions to the above, this cover film layer was hot pressed on the afore-mentioned printing paper. Thereafter, only the base material 2 made of a polyester film was released therefrom and thus a transfer cover film layer was formed. The whiteness degree of the color print in the experiment 7 of the present invention was measured by the color difference meter. The results was 92.9, and in the chromaticity coordinate of the CIE standard colorimetric system, x=0.306 and y=0.311 were established. Thus, it was confirmed that the above whiteness degree was improved as compared with the prior art. Similarly to the experiment 5 of the present invention, the cover film layer in the experiment 7 was pressed on the color copy to thereby form a color print. Then, when the color fading ratio thereof was measured, the cyan concentration of the color print before being exposed to the ultraviolet rays was 1.24 and that of the color print after being exposed to the ultraviolet rays was 1.20, the color fading ratio thereof being presented as 3.23%. In this experiment, it was confirmed that the color fading ratio was lowered more than the experiment 5 of the present invention.

In the experiment 8 of the present invention, a cover film was formed in such a fashion that 2-(2-hydroxy 5-methyl phenyl) 2H benzo triazol (TINUVIN P, manufactured by Ciba Geigy A.G.) of 5 PHR was dissolved into the cover material 1 prepared by the experiment 7 of the present invention as the ultraviolet ray absorbent so as to increase the color fading property more. This cover film was similarly pressed on the above color print and thereafter only the polyester film was released therefrom thus a sample color print being formed. Also in the experiment 8 of the present invention, ultraviolet rays were irradiated on the sample color print and the color fading ratio was measured similarly to the other experiment examples of the present invention. According to this measurement, the cyan concentration of the sample color print before being exposed to the ultraviolet rays was 1.24 and that of the sample color print after being exposed to the ultraviolet rays was 1.23, the color fading ratio being presented as 0.81%. As a result, it was confirmed that the color of the sample color print of this experiment was quite difficult to be faded.

As set forth above, according to the present invention, since the sublimation dye on the printing paper is diffused and colored and the whiteness degree of the non-colored portion can be increased, the picture image can be made clear. Further, since the color fading of dye due to ultraviolet rays is reduced, an excellent picture image can be enjoyed for so long.

The structure of the cover film 3 is not limited to the base material 2 made of polyester film but a base material such as polycarbonate, polyacrylate and the like having a smooth surface can be used. Also, a plastic film base material of relatively high heat resisting property which, if necessary, undergoes pear-skin treatment and releasing treatment can be used. Moreover, it is also possible that the layer of this base material is made a double structure layer as shown in FIGS. 3 or 4 and that the paper 2*a* is superposed on, for example, the polyester film 2*b*. Furthermore, it is possible to use a base material the smoothing property of which is raised by coating thereon a curable type heat resisting coating composition (for example, silicone resin, unsaturated polyester resin and so on). The thickness of the base material portion is selected to be in a range from 20 to 100 μm, preferably 20 to 50 μm. The above thickness is selected in consideration of the easy handling, time required by hot press and the like. A so-called supporting member such as the paper 2*a* and the like can be released and left over as the cover film depending on the kinds of paper, if necessary. The thickness of the cover material 1 is selected to be in a range from 1 to 20 μm, preferably 5 to 10 μm.

Furthermore, since most of sublimation dye belongs to the dispersing dye, a resin such as polyester, epoxy, nylon and the like on which the dispersing dye can be transferred quite easily is coated on the surface of the printing paper so as to increase the transfer property of the dye. For this reason, the resin which can be melted by heat on these resins must be selected from the cover films. It is sufficient that the combination of the resin permits the melting by heat with the cover film. In addition, in order to facilitate the base material 2 and the cover material 1 to be released from each other, it is possible that silicone-series or fluorine-series releasing treatment is carried out.

It is needless to say that the present invention is not limited to the above embodiments but can take various modifications without departing from the spirits of the invention.

We claim:

1. A color hard copy print comprising:

a printing substrate, sublimation dyes of three primary colors selectively formed on one surface of said printing substrate by thermal transfer of said dyes, and a cover film formed on said one surface of said substrate by melt bonding thereon, said cover film including a resinous layer containing an organic compound of a metal selected from the group consisting of Al, Mg, Ca, and Sn.

2. A hard copy print according to claim 1 wherein said resinous layer contains a phosphor whitener.

3. A hard copy print according to claim 2, characterized in that said phosphor whitener is selected from 4, 4'-bis 4, 6-di substituted - 1, 3, 5 - triadinyl sulfonic acid, α, β-bis (benzoxyzoryl) ethylene compound, alkoxy naphthalene acid-N-substituted imide compound, anthracene derivative, stilbene derivative, quinolone derivative, coumarin derivative, imidazol derivative and oxazol derivative.

4. A hard copy print according to claim 2, characterized in that amount of said phosphor whitener is selected in a range from 0.1 to 5 PHR.

5. A hard copy print according to claim 1, characterized in that said resinous layer of said cover film is selected from polyester resin, epoxy resin, acetate cellulose resin, nylon resin and polyvinyl pyrrolidone resin.

6. A hard copy print according to claim 1, characterized in that said metal compound is selected from organic acid metal salt, metal alcoholate, chelate compound of acetyl acetonate with metal and aluminum oxide acylate compound.

7. A hard copy print according to claim 1, characterized in that amount of said metal compound is selected to be in a range from 0.1 to 30 PHR.

8. A hard copy print according to claim 1, characterized in that said cover film has a thickness selected in a range from 1 to 20 μm.

* * * * *